US005675843A

United States Patent [19]

Grim et al.

[11] Patent Number: 5,675,843

[45] Date of Patent: Oct. 14, 1997

[54] HELMET VISOR ATTACHMENT APPARATUS

[75] Inventors: Michael Grim, Santa Cruz; Robert Paul Lakes, Campbell; John Evans Muhlner, Santa Cruz, all of Calif.

[73] Assignee: Bell Sports Inc., Scottsdale, Ariz.

[21] Appl. No.: 609,119

[22] Filed: Feb. 29, 1996

[51] Int. Cl.[6] ..... A42B 3/04

[52] U.S. Cl. ..... 2/422; 2/12

[58] Field of Search ..... 2/10, 12, 422, 2/425, 410, 411, 424; 24/324, 295, 297

[56] References Cited

U.S. PATENT DOCUMENTS

| | | | |
|---|---|---|---|
| 3,239,842 | 3/1966 | Marchello | 2/10 |
| 3,538,554 | 11/1970 | Ford | 24/324 |
| 4,117,553 | 10/1978 | Bay | 2/10 |
| 4,138,746 | 2/1979 | Bergmann | 2/424 |
| 4,333,180 | 6/1982 | Bay | 2/10 |
| 4,744,107 | 5/1988 | Fohl | 2/422 |
| 5,333,328 | 8/1994 | Roberts | 2/12 |
| 5,347,655 | 9/1994 | Garrett | 2/10 |
| 5,365,615 | 11/1994 | Piszkin | 2/10 |
| 5,469,584 | 11/1995 | Casartelli | 2/12 |

*Primary Examiner*—Michael A. Neas

*Attorney, Agent, or Firm*—Limbach & Limbach L.L.P.; George C. Limbach

[57] ABSTRACT

A helmet visor attachment apparatus is disclosed including an attachment protrusion with a semi-ball portion on the free end thereof on each side of the visor removably attachable to the helmet with a mounting plate which has an opening therethrough smaller than the semi-ball and slits extending from the opening permitting flexure of the mounting plate when the semi-ball is pressed through the opening.

7 Claims, 1 Drawing Sheet

HELMET VISOR ATTACHMENT APPARATUS

BACKGROUND OF THE INVENTION

The present invention relates in general to apparatus for attaching accessories to helmets and particularly apparatus for attaching visors to bicycle and other sports helmets.

In the past, various constructions have been used for attaching visors to bicycle and other sports helmets. These attachment means have included threaded inserts into the helmet to receive a screw or bolt, the use of hook and loop type fastening materials and the provision of a hole in the helmet body into which a member is frictionally inserted but which tend to wear and be unusable after a number of detachments and reattachments.

Applicants' invention is directed to an attachment apparatus for connecting accessories such as a visor to a helmet which can be used to quickly and easily attach and detach the accessory and which is inexpensive to manufacture, easy to apply to the helmet and yet will continue to operate successfully after repeated attachments and detachments.

SUMMARY OF THE INVENTION

The present invention is directed to apparatus for attaching an accessory member, such as a visor, to a helmet wherein the accessory member has at least one attachment protrusion which includes a stem portion projecting therefrom and a semi-ball portion on the free end of the stem portion. A flexible mounting plate is provided having an opening therethrough smaller then the semi-ball and a plurality of slits through the mounting plate and extending outwardly from the opening through the plate. Means, such as double stick tape, is provided for attaching the mounting plate to the helmet over an opening in the helmet whereby the semi-ball portion of the protrusion can be pushed through the plate opening to attach the accessory to the helmet.

One feature and advantage of the present invention is that a simple and inexpensive but durable apparatus is provided whereby an accessory can be repeatedly attached and detached from a helmet.

In accordance with another aspect of the present invention, the opening through the plate is substantially round and the slits extend substantially radially from the round opening.

In accordance with another aspect of the present invention, the opening in the plate for receiving the attachment protrusion is substantially square with expanded slits extending diagonally from the corners of the plate opening.

Further objects and advantages of this invention will become apparent from a consideration of the drawings and ensuing description.

DESCRIPTION OF THE PREFERRED EMBODIMENT

Figure 1:
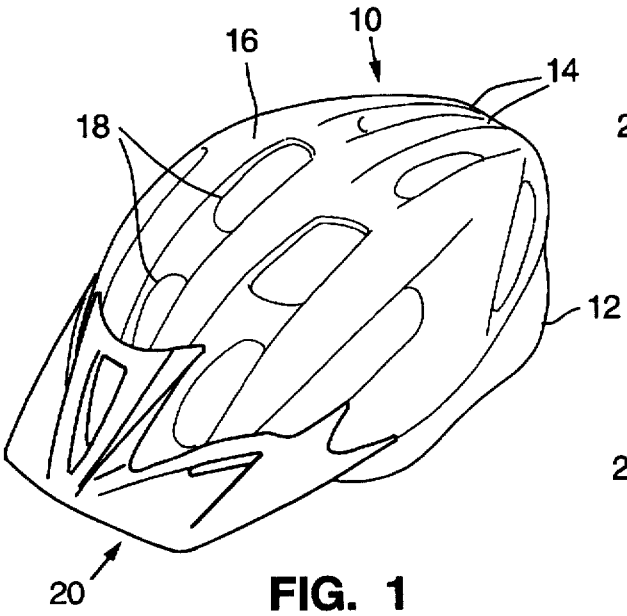
FIG. 1 is a prospective view of a bicycle helmet with a visor attached thereto utilizing the present invention.
Figure 2:
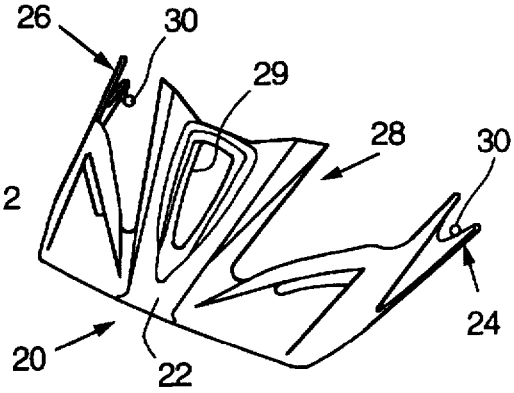
FIG. 2 is a prospective view of the visor removed from the helmet.
Figure 3:
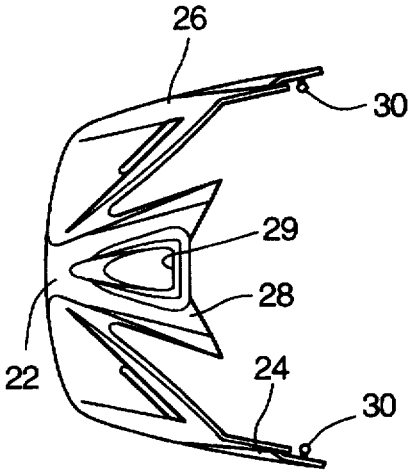
FIG. 3 is a top view of the structure shown in FIG. 2.

While the present invention is applicable to the attachment of various different articles and particularly suited for attachment of accessory members to bicycle and other sports helmets, the preferred embodiment of the invention is apparatus for removably attaching visors to bicycle helmets and will be described with reference thereto as shown in the drawing.

Referring now to the drawing, with particular reference to FIG. 1, there is shown a bicycle helmet 10 formed of a expanded foam shell 12 having shell vents 14 therethrough and with a cover 16 vacuum formed over the top portion of the foam shell 12. The cover 16 has cover vents 18 corresponding to the shell vents 14. A visor 20, such as of plastic, is removably attached to the helmet 10.

Referring now to FIGS. 2–5, the visor 20 has a front portion 22 which will project forwardly over the front edge of the helmet to shield the eyes of the wearer. Side portions 24 and 26 extend rearwardly from the two sides of the front portion 22, and a front upward extension 28 which includes a vent 29 alignable with one pair of the shell 12 and cover 16, vents 14 and 18, respectively, and which serves to aerodynamically carry air from the front of the helmet into the helmet vents and through the helmet.

Figure 5:
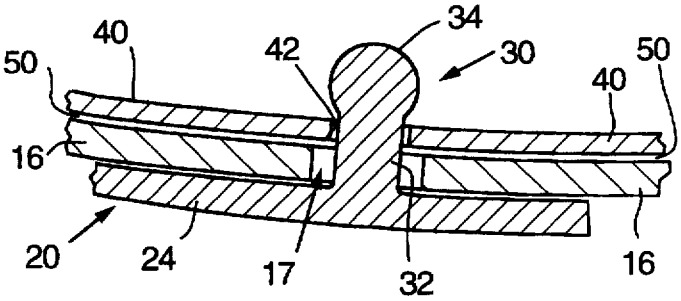
FIG. 5 is a cross-sectional view of a portion of the structure shown in FIG. 4, taken along line 5—5 in the direction of the arrows as mounted on a helmet utilizing the mounting plate shown in FIG 6A.
Figure 4:
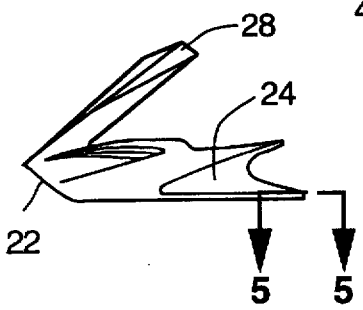
FIG. 4 is a side elevational view of the structure shown in FIG. 3.

Referring specifically to FIG. 5, the attachment apparatus includes an attachment protrusions 30 each formed integrally with the visor 20 and having a cylindrical stem 32 projecting from the inside surface of the visor side portions 24 and 26, which stem 32 has a semi-spherical end or semi-ball 34 on its free end.

Figure 6A:
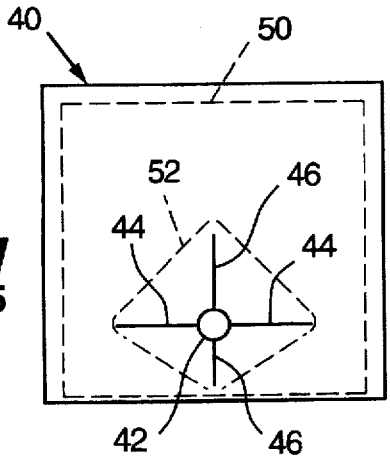
FIG. 6A is a top view of one mounting plate for use with the present invention.

Referring now to FIG. 6A, a flat, thin, flexible mounting plate 40, such as of plastic, is provided having an opening 42 with lateral and transverse slits 44 and 46, respectively, extending through the mounting plate 40 outwardly from the central opening 42. In the preferred embodiment as shown in FIG. 6A, the central opening is round and the slits 44 and 46 extend radially outwardly of the central opening 42. The diameter of the opening 42 is smaller then the diameter of the semi-ball 34 so that the semi-ball 34 can be seated in the opening 42 and pressed to allow the regions of the mounting plate between adjacent slits 44 and 46 to yield permitting the semi-ball 34 to pass through the opening 42 and then allow those regions to flex back to their normal position to capture the semi-ball 34 in place until it is pulled outwardly for removal of the visor 20. The mounting plate 40 is secured to the shell 12 of the helmet over a hole 17 in the cover 16 underneath the cover 16, preferably by double-sided foam stick tape 50 shown in phantom on the backside of the mounting plate 40 in FIG. 6A. The double-stick tape 50 has an opening 52 which extends between the outward ends of the slits 44 and 46 to permit the regions of the plate 40 between the adjacent slits 44 and 46 to flex so the semi-ball can pass through the opening 42.

Figure 6B:
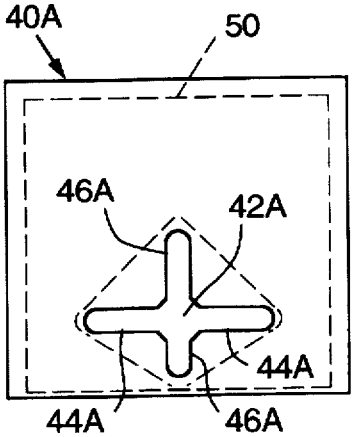
FIG. 6B is a top view of another mounting plate for use with the present invention.

An alternative embodiment of the mounting plate is shown in FIG. 6B wherein the central opening 42A is a square opening and lateral and transverse slits 44A and 46A, respectively, extend diagonally outwardly from the corners of the square opening 42A.

The front upward extension 28 of the visor can be attached to the helmet with one or more similar attachment protrusions or can be secured in place using hook and loop attaching means which will permit some variation in the tilted position of the visor to suit different light and/or wind conditions.

For full disclosure of operative embodiments of the present invention, and not in a limiting sense, an attachment assembly of the type shown in FIG. 6A can have a plate 40, 0.020 of an inch thick with a central opening 42, 0.152 of an inch in diameter to receive semi-ball 34, 0.160 of an inch in diameter on the end of a stem 32, 0.120 of an inch in diameter and wherein the lateral slits 44 are 0.280 of an inch long, the upper transverse slit 46 is 0.280 of an inch long and the lower transverse slit 46 is 0.130 of an inch long.

In the alternative embodiment shown in FIG. 6B, the square opening 42A is 0.152 of an inch on its side, the slits are 0.060 of an inch wide with the lateral slits being 0.280 of an inch in length, the upper transverse slit 46A, 0.280 an inch in length and the lower transverse slit 46A, 0.130 of an inch in length from the center of the opening 42.

It is to be understood that the present invention is not limited to the embodiments described above and illustrated herein, but encompasses any and all variations falling within the scope of the appended claims.

We claim:

1. Apparatus for attaching an accessory to a helmet comprising, in combination:

an accessory member, at least one attachment protrusion on said accessory member including a stem portion projecting from said accessory member and a semi-ball portion on the free end of said stem portion, a flexible mounting plate having an opening through said plate smaller than said semi-ball and a plurality of slits through said mounting plate and extending outwardly from said opening through said plate and means for attaching said mounting plate to the helmet over an opening in said helmet whereby said semi-ball portion of said protrusion can be pushed through said plate opening to attach said accessory member to the helmet.

2. The apparatus of claim 1 wherein said plate opening is substantially square and said slits are expanded and extend diagonally from the corners of said plate opening.

3. The apparatus of claim 1 wherein said plate opening is substantially round and said slits extend radially therefrom.

4. Apparatus for attaching a visor to a helmet comprising, in combination:

a visor member having a front portion and at least two side portions, at least one attachment protrusion on each of said visor member side portions, each protrusion including a stem portion projecting from said visor member and a semi-ball portion on the free end of said stem portion, flexible mounting plates for each of said visor side portions, each of said plates having an opening through said plate smaller than said semi-ball and a plurality of slits through said mounting plate and extending outwardly from said opening through said plate and means for attaching said mounting plates to the helmet over an opening in said helmet whereby said semi-ball portion of said protrusion can be pushed through said plate opening to attach said visor member to the helmet.

5. The apparatus of claim 4 wherein said plate openings are substantially square and said slits are expanded and extend diagonally from the corners of said plate openings.

6. The apparatus of claim 4 wherein said plate opening is substantially round and said slits extend radially therefrom.

7. The apparatus of claim 4 wherein said attaching means is double stick tape.

* * * * *